US008399526B2

(12) United States Patent
Marion et al.

(10) Patent No.: US 8,399,526 B2
(45) Date of Patent: Mar. 19, 2013

(54) METHOD FOR OPTIMIZING THE OPERATION OF A UNIT FOR THE SYNTHESIS OF HYDROCARBONS FROM A SYNTHESIS GAS

(75) Inventors: Marie-Claire Marion, Vernaison (FR); Francois Hugues, Vernaison (FR)

(73) Assignees: IFP Energies Nouvelles, Rueil-Malmaison Cedex (FR); ENI S.p.A., Rome (IT)

( * ) Notice: Subject to any disclaimer, the term of this patent is extended or adjusted under 35 U.S.C. 154(b) by 300 days.

(21) Appl. No.: 12/514,497

(22) PCT Filed: Nov. 2, 2007

(86) PCT No.: PCT/FR2007/001816

§ 371 (c)(1), (2), (4) Date: Aug. 17, 2010

(87) PCT Pub. No.: WO2008/065268

PCT Pub. Date: Jun. 5, 2008

(65) Prior Publication Data

US 2011/0009502 A1 Jan. 13, 2011

(30) Foreign Application Priority Data

Nov. 13, 2006 (FR) ..... 06 09879

(51) Int. Cl.
*C07C 27/00* (2006.01)

(52) U.S. Cl. ..... 518/715

(58) Field of Classification Search ..... None
See application file for complete search history.

(56) References Cited

FOREIGN PATENT DOCUMENTS

| | | | |
|---|---|---|---|
| WO | 2005123882 | A | 12/2005 |
| WO | WO 2005123882 | A1 * | 12/2005 |
| WO | PCTFR2007001816 | R | 5/2008 |

* cited by examiner

*Primary Examiner* — Yong Chu
(74) *Attorney, Agent, or Firm* — Millen, White, Zelano & Branigan, P.C.

(57) ABSTRACT

The invention concerns a method for optimizing the operation of a reaction section for hydrocarbon synthesis starting from a feed comprising synthesis gas, operated in the presence of a catalyst comprising cobalt. This method comprises the following steps: a) determining the theoretical molar ratio, $P_{H2O}$:$P_{H2}$, in the reaction section; b) optionally, adjusting the ratio $P_{H2O}$:$P_{H2}$ determined in step a) to a value strictly below 1; c) determining the new value for the theoretical ratio $P_{H2O}$:$P_{H2}$ in the reaction section; and repeating steps a) to c) until the ratio of the partial pressures of water and hydrogen, $P_{H2O}$:$P_{H2}$, has a value strictly less than 1.1.

17 Claims, No Drawings

METHOD FOR OPTIMIZING THE OPERATION OF A UNIT FOR THE SYNTHESIS OF HYDROCARBONS FROM A SYNTHESIS GAS

The present invention relates to the field of the synthesis of hydrocarbons from a mixture comprising carbon monoxide (CO), hydrogen ($H_2$) and possibly carbon dioxide ($CO_2$), generally known as synthesis gas.

The method of the invention means that the operation of a unit for synthesizing hydrocarbons starting from synthesis gas (also known as Fischer-Tropsch synthesis) can be optimized, or it can re-establish stable operation with a view to maximizing the yield of C5+ hydrocarbons (hydrocarbons containing 5 or more carbon atoms).

The method of the invention is a method for controlling the Fischer-Tropsch synthesis in which the ratio of the partial pressures of water and hydrogen, $P_{H2O}$:$P_{H2}$, is used as a control parameter for said synthesis.

PRIOR ART

The reaction for converting synthesis gas (CO—($CO_2$—$H_2$) mixture) into hydrocarbons has been known since the start of the twentieth century and is also termed the Fischer-Tropsch synthesis. The units were operated in Germany during the Second World War, then in South Africa to synthesize synthetic fuels. The majority of such units, essentially dedicated to the production of synthetic fuels, were or are still operated with iron-based catalysts.

More recently, interest in such syntheses has resurged, more particularly as regards the use of catalysts comprising cobalt which can orientate the reaction towards the formation of heavier hydrocarbons, principally paraffins, essentially C5+ hydrocarbons (hydrocarbons containing 5 or more carbon atoms per molecule), while minimizing the formation of methane and hydrocarbons containing 2 to 4 carbon atoms per molecule (C2-C4). The hydrocarbons formed thereby may be transformed in a downstream hydrocracking unit in order to produce mainly kerosene and gas oil. Such a process is, for example, described in patent EP-B-1 406 988. The use of a catalyst comprising cobalt is more suited to treating synthesis gas (feed) which is richer in hydrogen, derived in particular from the transformation of natural gas.

Many cobalt-based formulations have been described in the prior art (see, for example, patent applications EP-A-0 313 375 or EP-A-1 233 011). In contrast to iron-based catalysts which are active in the conversion of CO to $CO_2$ (water gas shift reaction, WGSR): $CO+H_2O \rightarrow CO_2+H_2$, cobalt-based catalysts have only a low activity for this reaction (B H Davies, Catalysis Today, 84, 2003, p 83).

However, under certain conditions, catalysts comprising cobalt may develop a CO conversion activity (WGSR) which then competes with the Fischer-Tropsch synthesis reaction and severely affects this synthesis. The CO conversion reaction (WGSR) consumes part of the reagent CO by forming $CO_2$ instead of the desired hydrocarbons and it simultaneously produces an excess of hydrogen which modifies the $H_2$:CO ratio and causes degradation of the selectivity of the reaction towards the lightest products. Thus, the selectivites for methane and C2 to C4 hydrocarbons are increased.

Patent U.S. Pat. No. 6,534,552 B2 describes a process for producing hydrocarbons from natural gas in which the natural gas is converted into synthesis gas which is sent to a Fischer-Tropsch synthesis section to produce hydrocarbons and a tail gas. A separation section can separate hydrogen from a fraction of that gas, said hydrogen being permanently recycled either to the Fischer-Tropsch section or to the synthesis gas production section.

Patent U.S. Pat. No. 4,626,552 describes a procedure for starting up a Fischer-Tropsch reactor, in which the $H_2$:CO ratio is maintained at a low value by imposing a hydrogen flow rate in the range 15% to 90% of the stabilized flow rate. Next, the flow rate of the gas feed, the pressure and the temperature are increased gradually and finally, the $H_2$:CO ratio is adjusted to the optimum desired value by increasing the inlet hydrogen flow rate.

SUMMARY OF THE INVENTION

The method of the invention is a method for optimizing the operation of a unit for synthesizing hydrocarbons starting from a feed comprising synthesis gas, operated in the presence of a catalyst comprising cobalt.

The method of the invention concerns a process for synthesizing hydrocarbons from a feed comprising synthesis gas, operated with a catalyst comprising cobalt. Said method comprises the following steps: determining the theoretical molar ratio of the partial pressures of water and hydrogen, $P_{H2O}$:$P_{H2}$, in the Fischer-Tropsch reaction section, followed by possible adjustment of said ratio then determining the new value for this ratio. These steps are then optionally repeated until said ratio has a value of less than 1.1, preferably strictly less than 1 and highly preferably strictly less than 0.9, still more preferably strictly less than 0.8, or even strictly less than 0.65.

This method for controlling the Fischer-Tropsch synthesis means that high performances can be maintained, especially as regards the yield of heavy products (C5+ hydrocarbons). It can also maximize the selectivity for the heaviest hydrocarbons in the Fischer-Tropsch reaction and prevent degradation of the selectivity due to development of the CO conversion reaction (WGSR).

DETAILED DESCRIPTION

The method of the invention is a method for controlling and optimizing the Fischer-Tropsch synthesis in which the molar ratio of the partial pressures of water and hydrogen, $P_{H2O}$:$P_{H2}$, in the Fischer-Tropsch reaction section is used as a parameter for controlling and optimizing this system.

The method of the invention can improve the operation of the Fischer-Tropsch synthesis unit by optimizing its yield and preventing any drift of selectivity towards the CO conversion reaction (water gas shift reaction or WGS reaction). This novel control and optimization method is of particular advantage during transitional phases, in particular when starting up a unit or during temporary dysfunction of the unit (for example, when an incident such as breakage of part of the feed supply occurs, which will disturb the operation of the reaction section).

This is also the case when the operating parameters (temperature, pressure, gas flow rate, etc) are modified due to a temporary dysfunction of the unit or due to catalyst deactivation. By way of illustration, we can mention the case in which, during the unit start up phase, the activity of the catalyst increases during its final construction stage in situ in the synthesis gas (H Schutz et al, Catalysis Today, 71, 351, 2002).

The envisaged aim is the synthesis of a mixture of hydrocarbons comprising mainly paraffins and mainly long carbon chain compounds (hydrocarbons containing more than 5 carbon atoms per molecule, preferably containing more than 20 carbon atoms per molecule), in the presence of a catalyst comprising cobalt, also known as the Fischer-Tropsch synthesis. In order to attain this objective, it is important to minimize as far as possible the transitional phases mentioned above during which conversion and/or selectivity of the Fischer-Tropsch reaction are not generally optimized.

The method for controlling and optimizing the operation of a hydrocarbon synthesis unit of the invention means that high performance can be maintained, in particular as regards the yield of heavy products (C5+ hydrocarbons). More precisely, it can maximize the selectivity for the heaviest hydrocarbons using the Fischer-Tropsch reaction and prevent degradation of the selectivity due to development of the CO conversion reaction.

In the Fischer-Tropsch synthesis unit of the invention, said catalyst may be used in a fixed bed (reactor with one fixed bed catalyst with one or more beds of catalyst in the same reactor) or, as is preferable, in a three-phase reactor (used in slurry mode) comprising the catalyst in suspension in an essentially inert liquid phase and the reactive gas phase (synthesis gas).

The synthesis gas used in the Fischer-Tropsch synthesis step of the invention may be obtained via transformation of natural gas, coal or biomass using processes such as steam reforming or partial oxidation, or by methanol decomposition, or from any other process which is known to the skilled person. Any feed comprising at least hydrogen and carbon monoxide may thus be suitable. Preferably, the synthesis gas used in the Fischer-Tropsch synthesis has a $H_2$:CO molar ratio in the range 1:2 to 5:1, more preferably in the range 1.2:2 to 3:1 and still more preferably in the range 1.5:1 to 2.6:1.

The Fischer-Tropsch synthesis is generally carried out at a pressure in the range 0.1 MPa to 15 MPa, preferably in the range 1 MPa to 10 MPa and more preferably in the range 1.5 MPa to 5 MPa. The hourly space velocity of the synthesis gas is generally in the range 100 to 20000 $h^{-1}$ (volume of synthesis gas per volume of catalyst per hour), preferably in the range 400 to 10000 $h^{-1}$.

Any catalyst comprising cobalt which is known to the skilled person is suitable for the method of the invention, in particular those mentioned in the "prior art" section in the present application. Preferably, the catalysts comprising cobalt which are used are deposited on a support selected from the following oxides: alumina, silica, zirconia, titanium oxide, magnesium oxide or mixtures thereof. Various promoters which are known to the skilled person may also be added, in particular those selected from the following elements: rhenium, ruthenium, molybdenum, tungsten, chromium. It is also possible to add at least one alkali or alkaline-earth to these catalytic formulations.

In the method of the invention, the following control steps are carried out:

a) determining the theoretical molar ratio, $P_{H2O}$:$P_{H2}$, in the reaction section;

b) optionally, adjusting the ratio $P_{H2O}$:$P_{H2}$ determined in step a) to a value strictly less than 1.1 using the means detailed below;

c) determining the new value for the ratio $P_{H2O}$:$P_{H2}$ adjusted in step b) using the method used in step a);

then optionally, if necessary, the next step d) after step c):

d) repeating steps a) to c) until the ratio of the partial pressures of water and hydrogen, $P_{H2O}$:$P_{H2}$, has a value strictly less than 1.1.

The ratio $P_{H2O}$:$P_{H2}$ of step a) may be determined using any means which is known to the skilled person. The reaction section may be constituted by one or more reactors. Step a) is preferably carried out using means selected from the means detailed below.

One preferred means consists of measuring the quantity of carbon monoxide in the gaseous effluent and evaluating the theoretical ratio, $P_{H2O}$:$P_{H2}$, from the degree of conversion of carbon monoxide in the whole of the reaction section comprising one or more reactors, the ratio $H_2$:CO in the feed and the ratio $H_2$:CO for the gas consumed by the reaction (also termed the use ratio).

The degree of conversion of carbon monoxide (Cv) is defined from measurements of the carbon monoxide which enters the reaction section for hydrocarbon synthesis (inlet CO) and the carbon monoxide which leaves said reaction section (outlet CO). These measurements are generally carried out by gas phase chromatography using a catharometric detector. In the same manner, the hydrogen is measured with a column and a specific detector in the gas streams entering and leaving the reaction section for hydrocarbon synthesis in order to calculate the various $H_2$/CO ratios.

Thus, the degree of conversion of carbon monoxide (Cv), the ratio (or $H_2$/CO quotient) of the feed (R1) and the use ratio (or $H_2$/CO quotient) (Rft) are defined as follows:

$$Cv=(\text{CO inlet}-\text{CO outlet})/\text{CO inlet}$$

$$R1=H_2/\text{CO feed}=H_2\ \text{inlet}/\text{CO inlet (mol/mol)}$$

$$Rft=H_2/\text{CO reaction}=(H_2\ \text{inlet}-H_2\ \text{outlet})/(\text{CO inlet}-\text{CO outlet}).$$

Thus, the theoretical ratio $P_{H2O}$:$P_{H2}$ in the reaction section can be evaluated using the following equation:

$$\text{Theoretical } P_{H2O}:P_{H2}=Cv/(R1-(Rft\times Cv)).$$

The use ratio Rft qualifies to some extent the intrinsic selectivity of the Fischer-Tropsch synthesis catalyst. It is generally determined under normal Fischer-Tropsch synthesis conditions, i.e. when the shift reaction (WGSR) is minor and practically negligible. By default, it can be taken to be equal to 2.0, in accordance with the general reaction stoichiometry of the Fischer-Tropsch synthesis reaction [1] which is repeated below, knowing that the estimation of the theoretical ratio $P_{H2O}$:$P_{H2}$ will be conservative (i.e. slightly under-estimated).

$$\text{Fischer-Tropsch reaction: } CO+2H_2 \rightarrow -(CH_2)- + H_2O \quad [1]$$

Step b) for optional adjustment of the ratio $P_{H2O}$:$P_{H2}$ determined in step a) to a value strictly less than 1 may be carried out using means selected from the following means:

i. increasing the feed flow rate;

ii. in the case in which the reaction section or the reactor is equipped with a recycler for unconverted gas, increasing the recycle ratio;

iii. continuously eliminating all or part of the water formed by the reaction;

iv. modifying the ratio $H_2$/CO at the inlet to the reaction section for hydrocarbon synthesis or at least one reactor of said section when there is a plurality;

v. reducing the operating temperature;

vi. reducing the pressure.

In more detail, this adjustment may be carried out using one of the following means:

i. Increasing the flow rate of fresh feed (synthesis gas) is one of the preferred means. It can reduce the contact time for the feed with the catalyst, and thus reduce the degree of conversion of CO per pass and as a consequence reduce the ratio $P_{H2O}$:$P_{H2}$. Further, this action has the advantage of increasing the productivity of the unit without degrading the intrinsic selectivity of the Fischer-Tropsch reaction.

ii. Increasing the recycle ratio of unconverted gas, in the case in which the reaction section or at least one reactor of said section is equipped with an internal recycle, constitutes one of the preferred modes of action. It causes a reduction in the degree of conversion per pass and as a consequence a reduction in the $P_{H2O}$:$P_{H2}$ ratio in the reaction section.

iii. Another method consists of continuously eliminating the water formed by the reaction using a separation device installed in at least one Fischer-Tropsch synthesis reactor or in a recycle loop. Such separation may, for example, be carried out using a drum which can separate the aqueous phase and the organic phase in a recycle loop or using a membrane installed in said loop or in at least one synthesis reactor.

iv. Modifying the $H_2$/CO ratio at the inlet to the reaction section for hydrocarbon synthesis or at least one hydrocarbon synthesis reactor:

a) this modification may be achieved by modifying the operating conditions of the synthesis gas production section located upstream of the Fischer-Tropsch reaction section and thus the $H_2$/CO ratio at the outlet from this synthesis gas section;

b) adding supplemental carbon monoxide at the inlet to the synthesis reaction section or to at least one reactor results in a reduction in the $H_2$/CO ratio of the feed and increases the total feed flow rate. Overall, the kinetic FT synthesis conditions are thus less favourable and this causes a reduction in the parameter $P_{H2O}$:$P_{H2}$. However, this option is generally not the most preferred option as it is difficult to carry out on an industrial scale. The availability of supplemental quantities of CO in effect necessitates action on the synthesis gas production unit with Modifying the $H_2$/CO ratio at the outlet from that unit.

c) adding supplemental hydrogen ($H_2$) to the inlet to the synthesis reaction section or to at least one reactor is generally easier to carry out on an industrial scale using a supplemental stream of hydrogen available on-site. This addition leads to an increase in the $H_2$/CO ratio in the feed to the Fischer-Tropsch reaction step. This supplemental excess hydrogen causes a reduction in the parameter $P_{H2O}$:$P_{H2}$. However, this option suffers from the disadvantage of modifying the intrinsic selectivity of the FT reaction due to the supplemental excess hydrogen in the feed. This modification leads to the greater formation of unwanted light products, in particular C2-C4 hydrocarbons and methane. This means is thus not a preferred means in accordance with the invention.

d) this modification may also occasionally be obtained by modifying the internal recycle conditions as detailed in ii).

v. Reducing the temperature results in slowing down the reaction kinetics in accordance with Arrhenius' law. As a consequence, the reduction in temperature causes a reduction in the CO conversion ratio and thus a reduction in the ratio $P_{H2O}$:$P_{H2}$. this action has the disadvantage of also reducing the productivity of the process.

vi. Reducing the pressure will also have an impact on the reaction kinetics and result in a reduction in the ratio $P_{H2O}$:$P_{H2}$ by reducing the degree of conversion. However, this means has a negative impact on the production of the process.

Which of these means is selected depends essentially on the means which are available in the industrial unit and the operating conditions at the time.

The highly preferred means used in optional step b) for optional adjustment of the ratio $P_{H2O}$:$P_{H2}$ are generally as follows:

I. increasing the feed flow rate;

II. in the case in which the reaction section or at least one reactor of said section is equipped with a recycler for unconverted gas, increasing the recycle ratio;

III. continuously eliminating all or part of the water formed by the reaction.

In certain cases, in particular after an incident on one unit such as an unforeseen reduction in the operating temperatures, for example, other means are preferably used in step b) for optional adjustment of the ratio $P_{H2O}$:$P_{H2}$, namely the following means:

reducing the operating temperature (case v);

modifying the $H_2$/CO ratio at the inlet to the Fischer-Tropsch synthesis reaction section (case iv).

In such cases, these means are generally easier to implement.

When the ratio $P_{H2O}$:$P_{H2}$ has been adjusted in step b), its new theoretical value is determined again (step c)) in order to check that it its strictly less than 1.1, preferably strictly less than 1.0 and more preferably strictly less than 0.9, still more preferably strictly less than 0.8 or even strictly less than 0.65.

If this is not the case, steps a) to c) are repeated (step d)) until the criterion that the theoretical ratio $P_{H2O}$:$P_{H2}$ is strictly less than 1.1, preferably strictly less than 1.0 and more preferably strictly less than 0.9, still more preferably strictly less than 0.8, or even strictly less than 0.65 is satisfied.

In summary, the invention concerns a method for optimizing the operation of a reaction section for hydrocarbon synthesis starting from a feed comprising synthesis gas, operated in the presence of a catalyst comprising cobalt, said method comprising the following steps:

a) determining the theoretical molar ratio $P_{H2O}$:$P_{H2}$ in the reaction section;

b) optionally, adjusting the ratio $P_{H2O}$:$P_{H2}$ determined in step a) to a value strictly below 1.1 using means selected from the following means:

i. increasing the feed flow rate;

ii. in the case in which the reaction section or at least one reactor of said section is equipped with a recycle for unconverted gas, increasing the recycle ratio;

iii. continuously eliminating all or part of the water formed by the reaction;

iv. modifying the ratio $H_2$/CO at the inlet to the reaction section for hydrocarbon synthesis or at least one hydrocarbon synthesis reactor;

v. reducing the operating temperature;

vi. reducing the pressure;

c) determining the new value for the theoretical ratio $P_{H2O}$:$P_{H2}$ in the reaction section; then optionally, when this is necessary, the following step d) after step c):

d) repeating steps a) to c) until the ratio of the partial pressures of water and hydrogen, $P_{H2O}$:$P_{H2}$, has a value strictly less than 1.1.

Said reaction section may comprise one or more hydrocarbon synthesis reactors.

The following examples illustrate the invention.

EXAMPLE 1

The Fischer-Tropsch synthesis reaction was operated in a device comprising an autoclave type continuously stirred three-phase reactor (CSTR [continuously stirred tank reactor]). This reactor could be maintained under pressure and at temperature and operated continuously. The reactor was supplied with a synthesis gas with a $H_2$/CO ratio which may be adjusted between 1.5 to 2.5.

The flow rate of the feed (synthesis gas) was monitored and could also be adjusted to increase or reduce the reaction time. Fischer-Tropsch synthesis was carried out at 230° C., 2 MPa, in the presence of 35 g of a catalyst containing 13% by weight of cobalt deposited on an alumina support having a specific surface area of approximately 150 $m^2$/g and a cubic gamma structure. The catalytic performances were evaluated by material balance by analyzing and measuring the various streams leaving the reactor. The compositions of the various departing streams (gas effluents, liquid hydrocarbon product and aqueous product) were determined by gas chromatography.

Several experiments were carried out under various different synthesis gas supply conditions:

Case 1: 80 Nl/h of synthesis gas with a $H_2$/CO ratio of 2.0;
Case 2: 70 Nl/h of synthesis gas with a $H_2$/CO ratio of 2.0;
Case 3: 60 Nl/h of synthesis gas with a $H_2$/CO ratio of 2.0;
Case 4: 40 Nl/h of synthesis gas with a $H_2$/CO ratio of 2.0;
Case 5: 100 Nl/h of synthesis gas with a $H_2$/CO ratio of 2.5;
Case 6: 88 Nl/h of synthesis gas with a $H_2$/CO ratio of 2.5;
Case 7: 75 Nl/h of synthesis gas with a $H_2$/CO ratio of 2.5;
Case 8: 70 Nl/h of synthesis gas with a $H_2$/CO ratio of 2.5;
Case 9: 64 Nl/h of synthesis gas with a $H_2$/CO ratio of 2.5;
Case 10: 78 Nl/h of synthesis gas with a $H_2$/CO ratio of 1.5;
Case 11: 66 Nl/h of synthesis gas with a $H_2$/CO ratio of 1.5;
Case 12: 56 Nl/h of synthesis gas with a $H_2$/CO ratio of 1.5.

The results obtained after 50 hours of test are shown in Table 1 below:

TABLE 1

| Case | R1 $H_2$/CO feed | Cv Conv. CO (%) | Rft $H_2$/CO Reaction | Theoretical $P_{H2O}$:$P_{H2}$ | $CO_2$ select'y (% C) | $CH_4$ select'y (% C) | C5+ select'y (% C) | C5+ prod'n (kg/kg · h) |
|---|---|---|---|---|---|---|---|---|
| 1 | 2.0 | 57.3 | 2.10 | 0.72 | 0.8 | 7.0 | 83.8 | 0.220 |
| 2 | 2.0 | 62.7 | 2.10 | 0.92 | 0.9 | 7.1 | 82.6 | 0.211 |
| 3 | 2.0 | 68.7 | 2.10 | 1.23 | 1.8 | 8.5 | 78.2 | 0.198 |
| 4 | 2.0 | 80.9 | 2.10 | 2.69 | 6.2 | 17.9 | 59.8 | 0.155 |
| 5 | 2.5 | 62.2 | 2.15 | 0.53 | 0.4 | 9.1 | 78.4 | 0.256 |
| 6 | 2.5 | 69.1 | 2.15 | 0.68 | 0.7 | 10.0 | 78.0 | 0.250 |
| 7 | 2.5 | 78.0 | 2.15 | 0.95 | 0.9 | 12.1 | 74.1 | 0.241 |
| 8 | 2.5 | 81.5 | 2.15 | 1.09 | 1.6 | 13.5 | 69.5 | 0.235 |
| 9 | 2.5 | 86.0 | 2.15 | 1.32 | 4.1 | 19.5 | 55.3 | 0.226 |
| 10 | 1.5 | 42.2 | 2.06 | 0.67 | 0.5 | 4.5 | 90.2 | 0.226 |
| 11 | 1.5 | 47.1 | 2.06 | 0.89 | 0.8 | 5.0 | 88.7 | 0.190 |
| 12 | 1.5 | 51.6 | 2.06 | 1.18 | 1.6 | 7.3 | 83.1 | 0.179 |

Selectivities, as % Carbon ($CO_2$, $CH_4$, C5+)

100×(number of moles of carbon in the form of $CO_2$ or $CH_4$ or C5+)/total number of moles of carbon transformed into products.

C5+ Productivity (kg/kg·h)

Kilograms of C5+ hydrocarbons formed per hour per kilogram of catalyst employed.

The results of Table 1 show that for $H_2$:CO ratios of 1.5 to 2.5, the $CO_2$ and methane selectivity rose substantially when the theoretical ratio $P_{H2O}$:$P_{H2}$ had a value of more than 1, which had a highly deleterious impact on the selectivity for C5+ hydrocarbons, the desired products in this synthesis. Below a $P_{H2O}$:$P_{H2}$ of 1, the influence of an increase in this ratio was much smaller.

EXAMPLE 2

Example of Readjustment of Ratio after Modification of Operating Parameter

Case No 2 of Example 1 was assumed to be the starting point (feed flow rate of 70 Nl/h). The performances obtained after 50 hours of test were those indicated in Table 1.

The temperature of the Fischer-Tropsch reaction section was increased by 5° C. (T=235° C. and 2 MPa) without changing the feed flow rate (synthesis gas at rate of 70 Nl/h). This caused a modification in the ratio $P_{H2O}$:$P_{H2}$ which rose above 1 and an increase in the methane and carbon dioxide ($CO_2$) selectivities. These conditions are summarized in case 13 of Table 2.

The operating conditions were kept constant (T=235° C. and 2 MPa), but the ratio $P_{H2O}$:$P_{H2}$ was adjusted by dint of increasing the feed flow rate which rose to 100 Nl/h (case 14). This produced a theoretical ratio $P_{H2O}$:$P_{H2}$<1 with lower $CO_2$ and methane selectivities, and a selectivity for C5+ hydrocarbons (hydrocarbons containing 5 or more carbon atoms) which was higher.

TABLE 2

| Case | R1 $H_2$/CO feed | Cv Conv. CO (%) | Theoretical $P_{H2O}$:$P_{H2}$ | $CO_2$ select'y (% C) | $CH_4$ select'y (% C) | C5+ select'y (% C) | C5+ prod'n (kg/kg · h) |
|---|---|---|---|---|---|---|---|
| 2 | 2.0 | 62.7 | 0.92 | 0.9 | 7.1 | 82.6 | 0.211 |
| 13 | 2.0 | 73.2 | 1.58 | 2.1 | 10.2 | 76.1 | 0.246 |
| 14 | 2.0 | 59.6 | 0.80 | 0.9 | 7.5 | 80.0 | 0.286 |

In case No 13, even though the C5+ hydrocarbon productivity increased slightly, a carbon loss was observed because the increase of conversion occurred with an increase in the methane and $CO_2$ selectivities. A much greater fraction of carbon present in the feed was thus transformed into methane and carbon dioxide, which are unwanted products. In contrast, returning to a theoretical ratio, $P_{H2O}$:$P_{H2}$, of less than 1 again resulted in a high productivity with a low selectivity for $CH_4$ and $CO_2$, and thus minimized the carbon losses.

The invention claimed is:

1. A method for optimizing the operation of a reaction section for hydrocarbon synthesis starting from a feed comprising synthesis gas, operated in the presence of a catalyst comprising cobalt, and flowing said feed into a reaction zone said method comprising the following steps:

a) determining the theoretical molar ratio, $P_{H2O}$:$P_{H2}$, in the reaction section;

b) adjusting the ratio $P_{H2O}$:$P_{H2}$ determined in step a) to a value strictly below 1.1 by any of the following steps:

i. increasing the feed flow rate;

ii. providing a reaction section or at least one reactor of said section with a recycler for unconverted gas, and adjusting resultant recycle ratio;

iii. continuously eliminating all or part of the water formed by the reaction;

iv. modifying the ratio $H_2$/CO at the inlet to the reaction section for hydrocarbon synthesis or to at least one hydrocarbon synthesis reactor;

v. reducing the operating temperature;

vi. reducing the pressure;

c) determining the new value for the theoretical ratio $P_{H2O}$:$P_{H2}$ in the reaction section.

2. A method according to claim 1, comprising conducting the adjustment of the ratio $P_{H2O}$:$P_{H2}$ (step b)) by one of the following:

i. increasing the feed flow rate;

ii. providing the reactor section with a recycler for unconverted gas, and adjusting resultant recycle ratio;

iii. continuously eliminating all or part of the water formed by the reaction.

3. A method according to claim 1, wherein the molar ratio $P_{H2O}$:$P_{H2}$ (steps a) and c)), is determined by conducting any of the following:

i. analyzing a gas stream at an outlet of said reaction section;

ii. measuring the quantity of carbon monoxide in gaseous effluent and evaluating the ratio from the degree of conversion of carbon monoxide and the $H_2$:CO ratio in the feed.

4. A method according to claim 1, in which the molar ratio $P_{H2O}$:$P_{H2}$ (steps a) and c)) is determined by measuring the quantity of carbon monoxide in the gaseous effluent and evaluating the ratio from the degree of conversion of carbon monoxide and the $H_2$:CO ratio in the feed, and optionally adjusting the ratio $P_{H2O}$:$P_{H2}$ (step b)) by any of the following:

i. increasing the feed flow rate;

ii. in the case in which the reactor is equipped with a recycler for unconverted gas, increasing the recycle ratio.

5. A method according to claim 1, in which the theoretical ratio $P_{H2O}$:$P_{H2}$ in the reaction section is evaluated using the following calculation: theoretical $P_{H2O}$:$P_{H2}$=Cv/(R1−(Rft×Cv));

in which:

Cv=(CO inlet−CO outlet)/CO inlet;

R1=$H_2$/CO feed=$H_2$ inlet/CO inlet (mol/mol);

Rft=$H_2$/CO reaction=($H_2$ inlet−$H_2$ outlet)/(CO inlet−CO outlet).

6. A method according to claim 1, in which the hydrocarbon synthesis is carried out in at least one reactor with a fixed bed catalyst.

7. A method according to claim 1, in which the hydrocarbon synthesis is carried out in at least one three-phase reactor comprising the catalyst in suspension in an essentially inert liquid phase and the reactive gas phase.

8. A method according to claim 1, in which the synthesis gas is a Fischer-Tropsch synthesis gas having a $H_2$:CO molar ratio in the range 1:2 to 5:1 and a Fischer-Tropsch synthesis is carried out at a pressure in the range of 0.1 MPa to 15 MPa, with an hourly space velocity of synthesis gas in the range of 100 to 20000 $h^{-1}$.

9. A method according to claim 8, in which the Fischer-Tropsch synthesis has a $H_2$:CO molar ratio in the range of 1.5:1 to 2.6:1 and the Fischer-Tropsch synthesis is carried out at a pressure in the range of 1.5 MPa to 5 MPa, with an hourly space velocity of synthesis gas in the range of 400 to 10000 $h^{-1}$.

10. A method according to claim 1, in which at the end of step (b) the molar ratio, or the ratio of the partial pressures of water and hydrogen, $P_{H2O}$:$P_{H2}$, has a value strictly less than 1.

11. A method according to claim 1, in which at the end of step (b) the molar ratio or the ratio of the partial pressures of water and hydrogen, $P_{H2O}$:$P_{H2}$, has a value strictly less than 0.65.

12. A method according to claim 1, wherein the molar ratio $P_{H2O}$:$P_{H2}$ is adjusted by increasing the feed flow rate.

13. A method according to claim 1, in which at the end of step (b) the molar ratio, or the ratio of the partial pressures of water and hydrogen, $P_{H2O}$:$P_{H2}$, has a value strictly less than 0.9.

14. A method according to claim 1, in which at the end of step (b) the molar ratio, or the ratio of the partial pressures of water and hydrogen, $P_{H2O}$:$P_{H2}$, has a value strictly less than 0.8.

15. A process according to claim 1, comprising (d) repeating steps (a), (b) and (c).

16. A method according to claim 1, conducted at startup of said reaction section.

17. A method according to claim 1, conducted at-temporary dysfunction of said reaction section.

* * * * *

UNITED STATES PATENT AND TRADEMARK OFFICE

CERTIFICATE OF CORRECTION

PATENT NO. : 8,399,526 B2
APPLICATION NO. : 12/514497
DATED : March 19, 2013
INVENTOR(S) : Marion et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 849 days.

Signed and Sealed this
First Day of September, 2015

Michelle K. Lee

Michelle K. Lee
*Director of the United States Patent and Trademark Office*